United States Patent [19]

Brandell

[11] 4,313,495

[45] Feb. 2, 1982

[54] DOWNHOLE PUMP WITH PRESSURE LIMITER

[75] Inventor: John T. Brandell, Duncan, Okla.

[73] Assignee: Halliburton Services, Duncan, Okla.

[21] Appl. No.: 159,305

[22] Filed: Jun. 13, 1980

[51] Int. Cl.[3] ..... E21B 43/12

[52] U.S. Cl. ..... 166/53; 166/105; 417/223

[58] Field of Search ..... 166/106, 101, 187, 53, 166/104, 105; 175/101, 107, 93, 99; 417/223; 192/91 A

[56] References Cited

U.S. PATENT DOCUMENTS

| | | | |
|---|---|---|---|
| 1,046,585 | 12/1919 | Haakonson | 192/91 A |
| 2,690,224 | 0/0000 | Roberts . | |
| 3,083,774 | 0/0000 | Peters et al. . | |
| 3,291,219 | 0/0000 | Nutter . | |
| 3,439,740 | 4/1969 | Conover | 166/101 |
| 3,926,254 | 12/1975 | Evans et al. . | |
| 4,118,151 | 10/1978 | Murakami | 192/91 A |

*Primary Examiner*—William F. Pate, III

*Attorney, Agent, or Firm*—John H. Tregoning; James R. Duzan; Lucian W. Beavers

[57] ABSTRACT

A well testing assembly includes a pressure limiter located between a downhole pump and an inflatable packer. The pressure limiter includes a housing having first and second housing parts and having an inflation passage disposed therein for communicating a discharge of the downhole pump with the inflatable packer. A clutch is connected between the first and second housing parts. A biasing spring biases the clutch toward an engaged position. A piston is operatively associated with the clutch and communicated with the inflation passage for overcoming the biasing spring and moving the clutch to a disengaged position at a predetermined fluid pressure level within the inflation passage.

50 Claims, 15 Drawing Figures

DOWNHOLE PUMP WITH PRESSURE LIMITER

The present invention relates generally to pressure limiters for downhole pumps, and more particularly, but not by way of limitation, for pressure limiters for limiting an inflation pressure communicated from a downhole pump to an inflatable packer.

The pressure limiter of the present invention is constructed for use with a downhole pump of the type having first and second pump parts with relative rotation between said first and second pump parts being required to operate the pump and discharge a fluid under pressure therefrom.

Two examples of such pumps are shown in U.S. Pat. No. 3,926,254 to Evans et al., and assigned to the assignee of the present invention, and U.S. Pat. No. 3,439,740 to Conover.

The Evans et al. patent discloses a relief valve type of pressure limiting device designated as a limit valve member 242 and that member is described in detail at column 8, lines 6–61 of the Evans et al. disclosure.

The pressure limiter of the present invention is preferably utilized with an improved version of such pumps disclosed in my co-pending U.S. patent application No. 057,093 filed July 12, 1979, entitled "Downhole Pump and Testing Apparatus" and assigned to the assignee of the present invention.

A pressure limiting device which has previously been used by the assignee of the present invention for over one year, with downhole pumps such as that of Evans et al. and of my co-pending application Ser. No. 057,093, is a spring loaded torque limiting device which is run above the downhole pump to limit the torque which can be transferred thereto by the rotating drill string. That device operates on a ratcheting principle wherein a maximum torque which can be transferred between two components thereof is determined by the frictional force required to slide or ratchet two parts thereof relative to each other, which frictional force is determined by a normal force dependent upon the compression of a spring member thereof.

Other downhole pumps and packer assemblies for well testing are disclosed in U.S. Pat. No. 3,291,219 to Nutter, U.S. Pat. No. 3,083,774 to Peters et al., and U.S. Pat. No. 2,690,224 to Roberts, which disclosures are not believed to be as relevant as the Evans, et al. and Conover devices discussed in more detail above.

The present invention provides a pressure limiter including a housing having first and second housing parts and having a fluid passage means disposed therein for communication with a discharge of a downhole pump. A clutch means is connected to the first and second housing parts and is movable between an engaged position for preventing relative rotational movement between the first and second housing parts and a disengaged position for allowing relative rotational movement between said first and second housing parts.

A biasing means is operatively associated with the clutch means for biasing the clutch means towards its engaged position. Piston means are provided and are operably associated with the clutch means and are communicated with the fluid passageway, for overcoming the biasing means and moving the clutch means to its disengaged position at a predetermined fluid pressure level within the fluid passageway.

Numerous objects, features and advantages of the present invention will be readily apparent to those skilled in the art upon a reading of the following disclosure when taken in conjunction with the accompanying drawings.

FIGS. 1A–1D comprise a sectioned elevation right side only view of a preferred embodiment of a pressure limiter of the present invention.

FIGS. 2A–2D comprise a sectioned elevation right side only view of an alternative embodiment of the pressure limiter of the present invention.

FIG. 9 is a schematic elevation view of a well testing assembly including the pressure limiter of the present invention in place within a well hole.

Figure 1A:
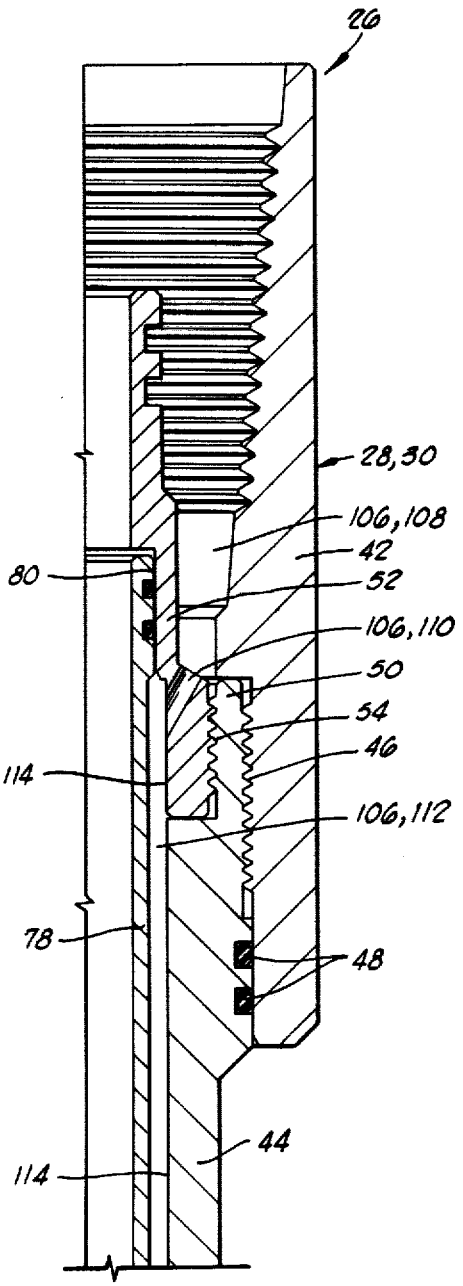
Figure 1B:
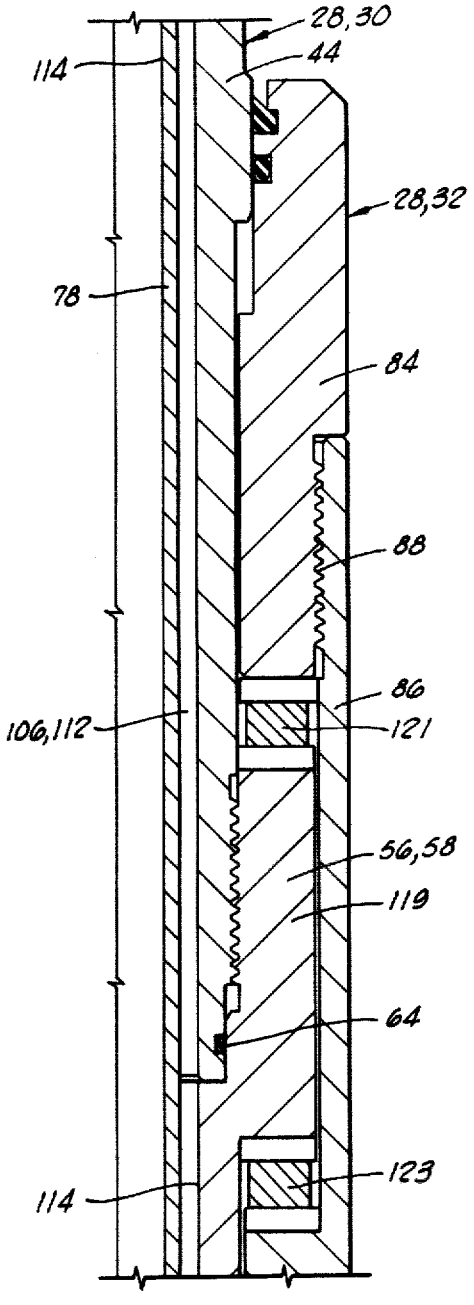

Referring now to FIG. 9, a well testing assembly of the present invention, generally designated by the numeral 10, is thereshown in place within a well hole 12.

The well testing assembly 10 includes a pipe string 14, the upper end of which is connected to a conventional rotary drilling rig (not shown) located at the surface and the lower end of which is connected to a downhole pump 16.

The downhole pump 16 includes an upper pump portion 18 and a lower pump portion 20. The upper and lower pump portions 18 and 20 are operably associated so that the pump 16 is operated on relative rotational movement between upper and lower pump portions 18 and 20. As mentioned, the downhole pump 16 may be constructed in a manner similar to any of U.S. Pat. No. 3,926,254 to Evans et al., U.S. Pat. No. 3,439,740 to Conover, and may co-pending U.S. patent application Ser. No. 057,093, all of which are incorporated herein by reference.

When the lower pump portion 20 is held fixed relative to well hole 12 and the upper pump portion 18 is rotated by rotation of the pipe string 10, the pump 16 operates to produce fluid under pressure. If the lower pump portion 20 is not fixed relative to well hole 12, and instead is allowed to rotate with upper pump portion 18 when pipe string 10 is rotated, then the pump 16 does not operate and no pressurized fluid is produced thereby.

Connected to the lower pump portion 20 is an intake screen assembly 22 through which fluid from an annulus 24 between pipe string 10 and well hole 12 is drawn to the suction side of downhole pump 16.

Connected to the lower end of screen assembly 22, and to the lower pump portion 20 through the screen assembly 22, is the pressure limiter 26 of the present invention, which includes a housing 28 having an upper housing part 30 and a lower housing part 32.

Connected below pressure limiter 26 are a first inflatable packer 34 and a second inflatable packer 36, which have a perforated intake portion 38 located therebetween adjacent a subsurface formation 39, the production of which is to be tested by the well testing assembly 10.

Located below the second inflatable packer 36 is a conventional drag spring assembly 40 which resiliently engages the wall of well hole 12 to prevent rotation of those components attached thereto relative to well hole 12.

The general manner of operation of the well testing assembly 10 is similar to that described in detail in U.S. Pat. No. 3,926,254 to Evans et al. and illustrated in the schematic FIGS. 1-5 thereof. An additional feature provided to this operation by the pressure limiter of the present invention is that upon the inflation pressure from the pump discharge to the inflatable packers reaching a predetermined level, the pressure limiter of the present invention disengages a clutch means contained therein to allow the upper housing part 30 to rotate relative to the lower housing part 32 thereby permitting the lower pump part 20 to rotate with the upper pump part 18 so as to prevent further increase of the inflation pressure by the pump means 16.

Referring now to FIGS. 1A-1D which comprise a sectioned elevation right side only view of a preferred embodiment of the pressure limiter 26 of the present invention, the details of construction of the housing 28 and its upper and lower parts 30 and 32 are thereshown.

The upper housing part 30 includes an upper adapter 42 and an upper mandrel 44 connected at threaded engagement 46 with a seal therebetween provided by seals 48.

An upper end 50 of upper mandrel 44 is also connected to a seal mandrel 52 at threaded connection 54.

Upper housing part 30 further includes a splined mandrel 56 comprising upper and lower splined mandrel portions 58 and 60, respectively, connected together at threaded connection 62. A seal is provided between upper and lower splined mandrel portions 58 and 60 by annular sealing ring 64.

Also included in the upper housing part 30 is a mandrel stinger 66 attached to the lower end of splined mandrel 56 at threaded connection 68.

Further included in upper housing part 30 is a clutch mandrel 70 which is concentrically disposed about lower splined mandrel portion 60 and which is connected thereto by an interlocking means 72 comprising splines 74 and 76 on lower splined mandrel portion 60 and clutch mandrel 70, respectively, for preventing relative rotational movement between splined mandrel 56 and clutch mandrel 70 while allowing relative longitudinal movement therebetween.

A central flow tube 78 has its upper end closely received within an inner cylindrical surface 80 of seal mandrel 52 and has its lower end closely received within an inner cylindrical surface 82 of mandrel stinger 66.

The lower housing part 32 of housing 28 of pressure limiter 26 includes a bearing retainer 84 connected to a bearing housing 86 at threaded connection 88. Also included is a spring case 90 attached to the lower end of bearing housing 86 at threaded connection 92.

Lower housing part 32 further includes a clutch housing 94 connected to the lower end of spring case 90 at threaded connection 96, and a lower adapter 98 connected to clutch housing 94 at threaded connection 100.

A lower end of mandrel stinger 66 of upper housing part 30 is closely received within an inner bore 102 of lower adapter 98 of lower housing portion 32, and a seal therebetween is provided by seal means 104.

The housing 28 of pressure limiter 26 has an inflation passage 106 disposed therethrough for communicating a discharge of downhole pump 16 with the inflatable packers 34 and 36. The inflation passage 106 includes an annular space 108 between seal mandrel 52 and upper adapter 42, a skewed port 110 disposed through a side wall of seal mandrel 52, an annular space 112 between flow tube 78 and an inner bore 114 of upper housing part 30, ports 115 and 116 through a wall of lower splined mandrel portion 60, an irregular annular space 118 between upper housing part 30 and lower housing part 32, and a longitudinal hole 120 communicated with the lower end of lower adapter 98.

A shoulder 119 at the upper end of upper splined mandrel portion 58 of upper housing part 30 is rotatingly mounted within lower housing part 32 by bearing blocks 121 and 123.

Figure 1C:
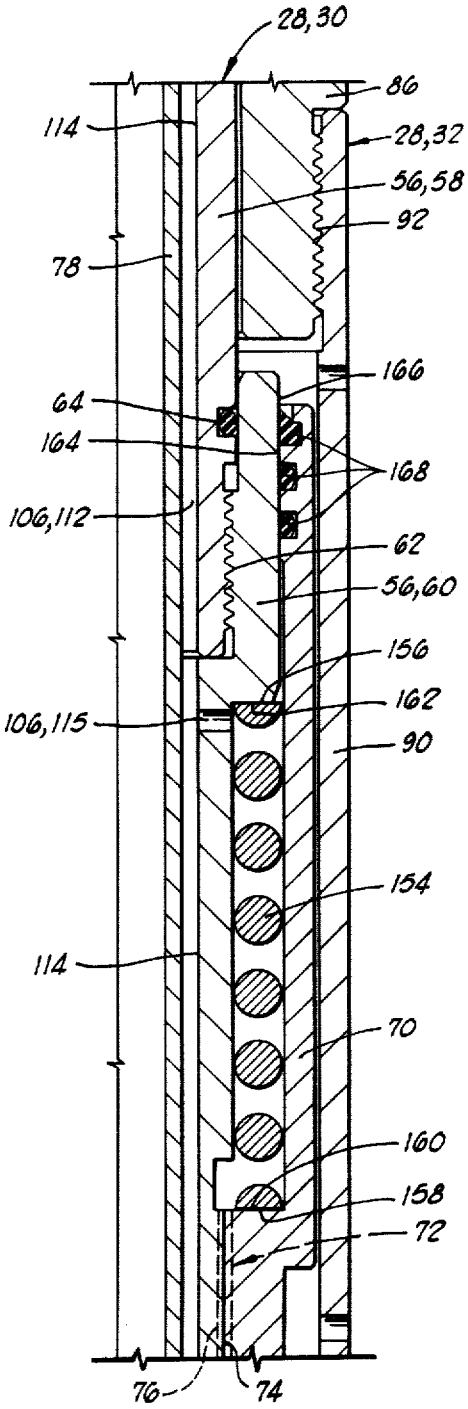
Figure 1D:
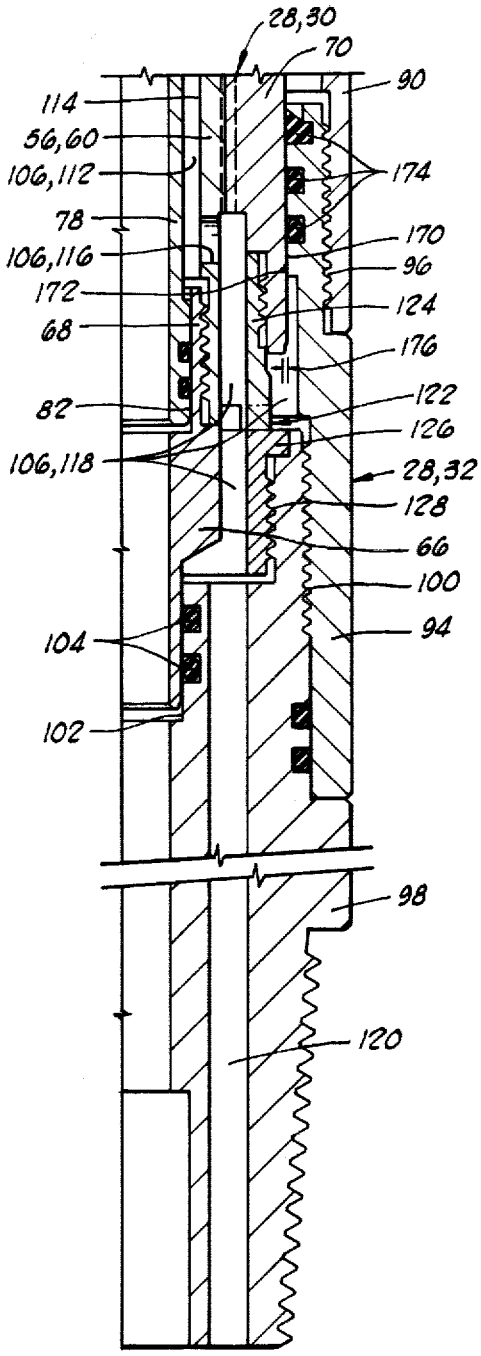

A clutch means generally designated by the numeral 122 is connected to upper and lower housing parts 30 and 32 and is movable between an engaged position illustrated in FIG. 1D for preventing relative rotational movement between upper and lower housing parts 30 and 32, and for holding lower pump portion 20 fixed relative to well hole 12 so that the downhole pump 16 is operated upon rotation of pipe string 10, and a disengaged position for allowing relative rotational movement between upper and lower housing parts 30 and 32, and for allowing lower pump portion 20 to rotate with the upper pump portion 18 upon rotation of pipe string 10 to prevent operation of the downhole pump 16.

The clutch means 122 includes an upper clutch part 124 attached to clutch mandrel 70 of upper housing part 30, and a lower clutch part 126 attached to lower adapter 98 of lower housing part 32 at threaded connection 128.

Referring now to FIGS. 3-5 and FIGS. 6-8, the details of construction of upper and lower clutch parts 124 and 126, respectively, are thereshown.

Upper clutch part 124 includes a lower annular surface 130 with a first pair of diametrically opposed longitudinally downward extending lugs 132 and 134 disposed thereon.

Lower clutch part 126 includes an upper annular surface 136 with a second pair of diametrically opposed longitudinally upward extending lugs 138 and 140 disposed thereon.

Figure 4:
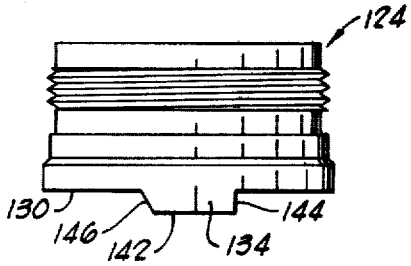
FIG. 4 is a side elevation view of the upper clutch part of FIG. 3 rotated 90° about its longitudinal axis from the orientation shown in FIG. 3.
Figure 5:
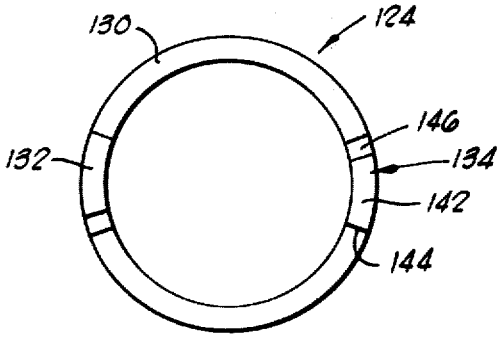
FIG. 5 is a bottom view of the upper clutch part of FIG. 3.

Referring to FIGS. 4 and 5, the lug 134 of the first pair has a flat bottom surface 142, a vertical right side surface 144 and a sloped left side surface 146. The other lug 132 of the first pair of lugs disposed on upper clutch part 124 is similarly constructed.

Figure 7:
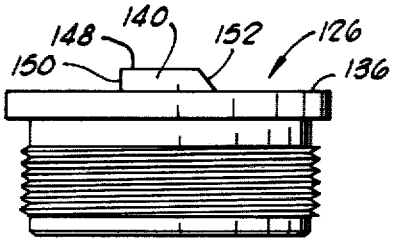
FIG. 7 is a side elevation view of the lower clutch part of FIG. 6 rotated 90° about its longitudinal axis from the orientation shown in FIG. 6.
Figure 8:
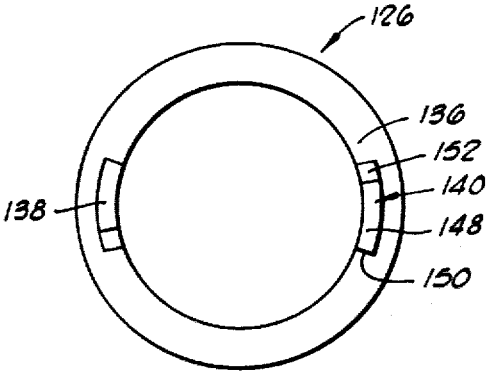
FIG. 8 is a bottom view of the lower clutch part of FIG. 6.
Figure 8:
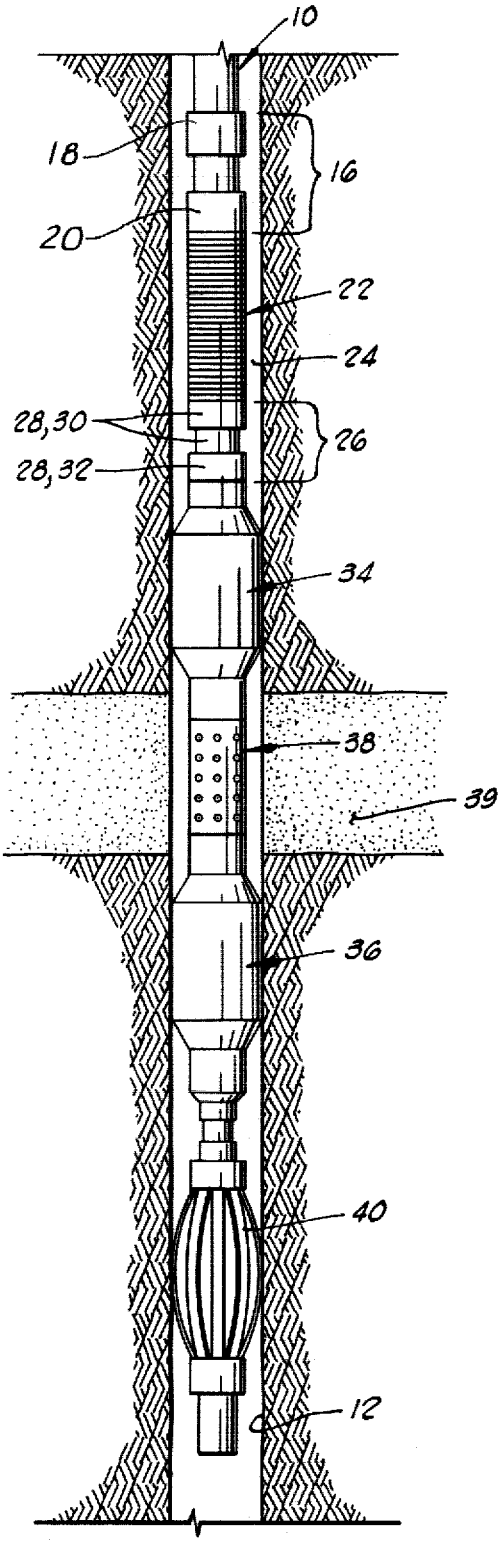

Referring now to FIGS. 7 and 8, and particularly to FIG. 7, the lug 140 of the second pair of lugs has a flat top surface 148, a vertical left side surface 150, and a sloped right side surface 152. The other lug 138 of the second pair of lugs disposed on lower clutch part 126 is similarly constructed.

When the first and second clutch parts 124 and 126 are engaged as shown in FIG. 1D, the bottom surfaces 142 of the first pair of lugs engage the annular surface 136 of the lower clutch part 126, and the top surfaces 148 of the lugs 138 and 140 of the lower clutch part 126 engage the lower annular surface 130 of the upper clutch part 124. Upon right hand rotation of the drill string 10, the upper clutch part 124 is rotated clockwise as viewed from above and the sloped surfaces 146 of lugs 132 and 134 are moved into engagement with the sloped surfaces 152 of lugs 138 and 140 so that the continued engagement of sloped surfaces 146 with sloped surfaces 152 prevents rotation of upper clutch part 124 relative to lower clutch part 126.

The sloped surfaces 146 and 152 on the first and second pairs of lugs create a longitudinal force component therebetween urging the first and second pair of lugs, and the upper and lower clutch parts 124 and 126, toward a disengaged position when a torque is transmitted across said sloped surfaces. This feature assists in the disengagement of the lugs of upper and lower clutch parts 124 and 126. If the engaging surfaces of the lugs were vertical, the frictional force therebetween due to the torque being transmitted thereacross would affect the longitudinal separating force required to move the upper and lower clutch parts 124 and 126 apart to a separated disengaged position.

The sloped surfaces 146 and 152 are preferably sloped at an angle of approximately 45° to the longitudinal axis of pressure limiter 26.

Referring now to FIG. 1C, a biasing means 154, which is a coil compression spring, is operatively associated with the clutch means 122 for biasing the clutch means towards its engaged position. Biasing means 154 includes upper and lower ends 156 and 158, respectively, both of which engage components of the upper housing part 30.

More specifically, the lower end 158 of coil compression spring 154 engages an annular radially inward extending upward facing shoulder 160 of clutch mandrel 70, and upper end 156 of coil compression spring 154 engages an annular radially outward extending downward facing shoulder 162 of lower splined mandrel portion 60. The lower splined mandrel portion 160 may generally be referred to as an inner mandrel relative to the clutch mandrel 70 since lower splined mandrel portion 60 is received within the clutch mandrel 70.

Clutch mandrel 70 includes an upper inner cylindrical surface 164 within which is closely received an outer cylindrical surface 166 of lower splined mandrel portion 60. Sealing means 168 are disposed between surfaces 164 and 166.

Clutch mandrel 70 further includes a lower outer cylindrical surface 170 closely received within an inner cylindrical surface 172 of clutch housing 94 of lower housing part 32. Sealing means 174 are disposed between surfaces 170 and 172.

The diameter of outer cylindrical surface 170 of clutch mandrel 70 is greater than the diameter of inner cylindrical surface 164 of clutch mandrel 70 so that an annular differential area piston means 176 is defined on clutch mandrel 70. The piston means 176 is communicated with inflation passage 106 and is operably associated with the clutch means 122 through the clutch mandrel 70 for overcoming the downward biasing force exerted upon clutch mandrel 70 by coil compression spring 154, and for moving the clutch means 122 to its disengaged position at a predetermined fluid pressure level, preferably about 1500 p.s.i., within inflation passage 106. The pressure within inflation passage 106 acting upward against the annular differential area of piston means 176 urges the clutch mandrel 70 upward against the downward force exerted by coil compression spring 154.

The differential area of piston means 176 has an inner diameter defined by the diameter of inner cylindrical surface 164 of clutch mandrel 70 and an outer diameter defined by the diameter of outer cylindrical surface 170 of clutch mandrel 70.

It will be appreciated by those skilled in the art that there is a slight clearance between inner cylindrical surface 164 and the outer cylindrical surface 166 of lower splined mandrel portion 60 received therein, and a similar slight clearance between outer cylindrical surface 170 of clutch mandrel 70 and inner cylindrical surface 172 of clutch housing 94. These clearances are sealed by the resilient O-ring sealing means 168 and 174, respectively. The actual inner and outer diameters defining the annular differential area of piston means 176 are exactly defined by the diameter at which the respective sealing means 168 and 174 engage outer cylindrical surface 166 and outer cylindrical surface 170. It will be understood by those skilled in the art that the sealing means may be disposed in grooves in either of two closely engaging cylindrical surfaces and the slight clearance therebetween does not substantially affect the area of annular surface 176. Thus, when it is said that the inner diameter of annular differential area piston means 176 is defined by the diameter of inner cylindrical surface 164 at the upper end of clutch mandrel 70, it is understood that the actual inner diameter of the effective annular differential area piston means 176 is defined by the diameter of the surface slidingly and sealingly engaged by seals 168 which diameter may vary by the clearance between surfaces 164 and 166 depending upon whether the seals are disposed in grooves in surface 164 or in surface 166.

The components of the pressure limiter 26 are so arranged and constructed that when the fluid discharge pressure, from downhole pump 16, within the inflation passage 106 is below a predetermined level, the coil spring biasing means 154 urges the upper clutch part 124 downward into engagement with the lower clutch part 126 to prevent relative rotational movement between the upper and lower housing parts 30 and 32. When said fluid discharge pressure is above said predetermined level, the upward force of said pressure within the inflation passage 106 acting against the annular differential area of piston means 176 moves the clutch mandrel 70 upward overcoming the biasing force of spring 154 and moves the lugs 132 and 134 of upper clutch part 124 upward out of engagement with the lugs 138 and 140 of lower clutch part 126 to thereby allow relative rotational movement between the upper and lower housing parts 30 and 32.

Referring now to FIGS. 2A–2D, an alternative embodiment of the pressure limiter of the present invention is thereshown and generally designated by the numeral 26A. Components of the pressure limiter 26A of FIGS. 2A–2D which are substantially identical to corresponding components of the pressure limiter 26 of FIGS. 1A–1D are designated by the identical numerals. Similar components which have been modified are designated by the original numeral with the addition of the suffix "A".

Figure 2A:
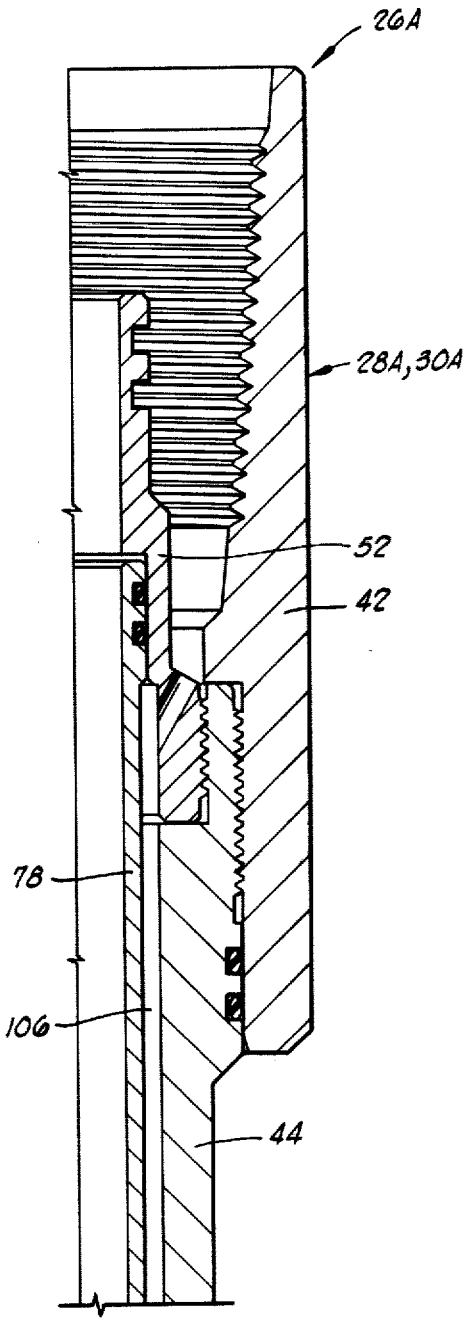
Figure 2B:
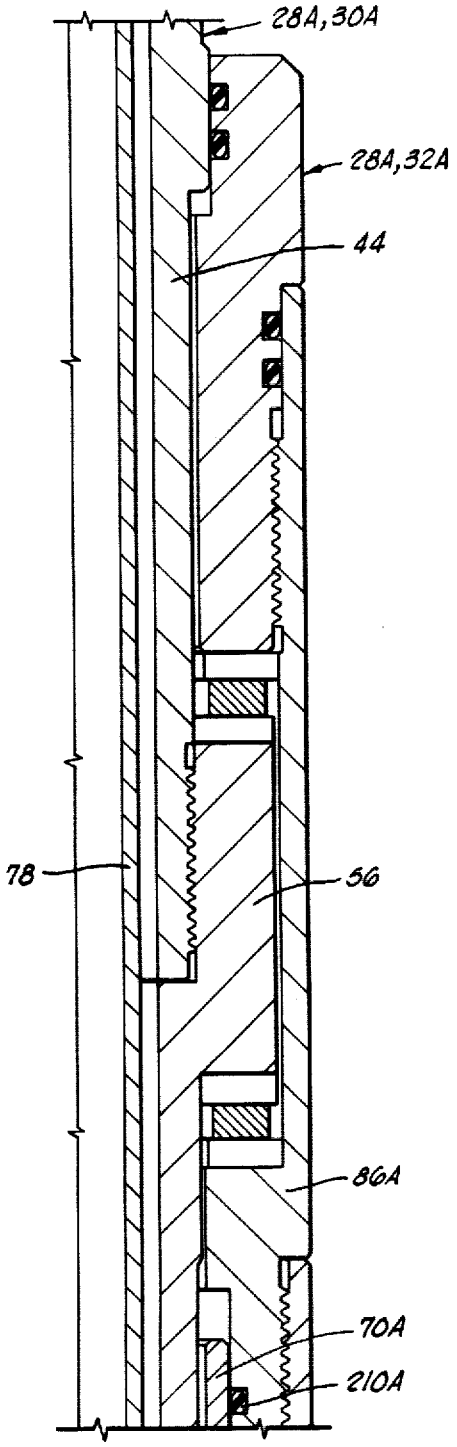
Figure 2C:
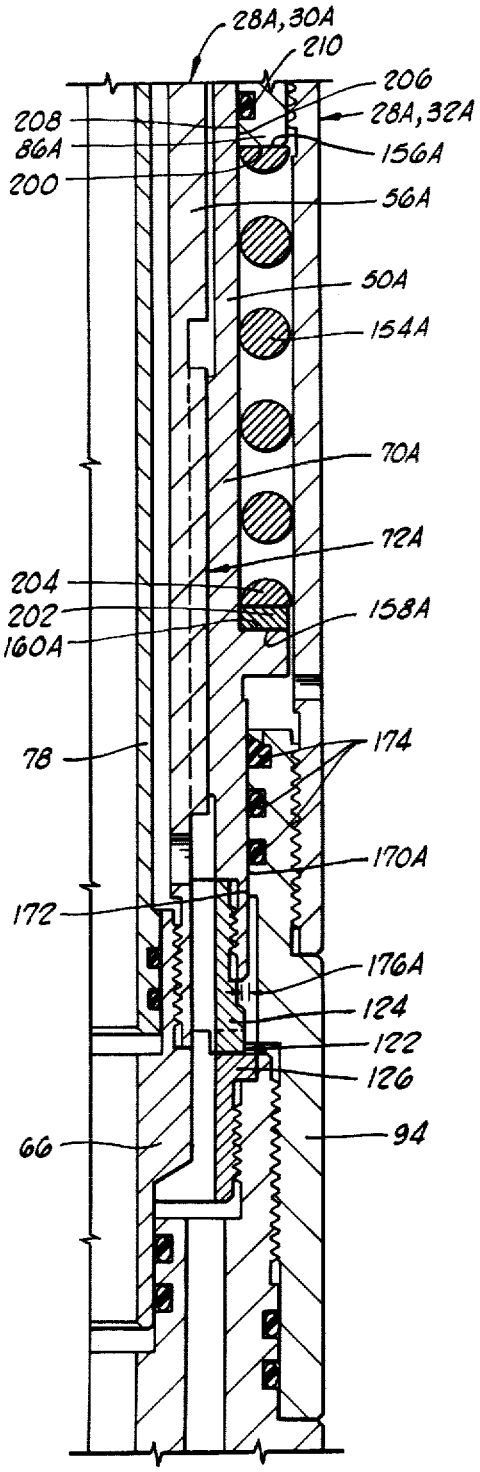
Figure 2D:
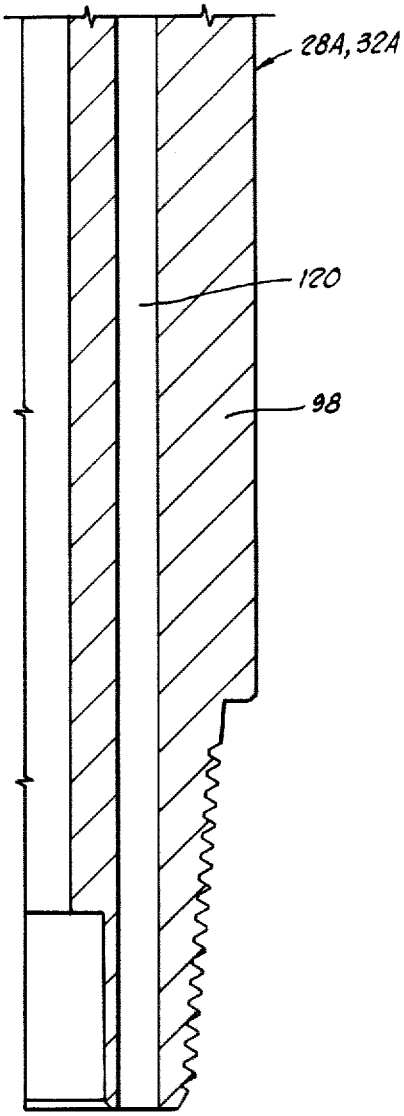
Figure 3:
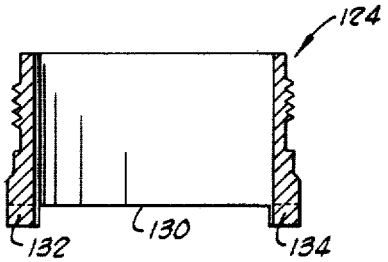
FIG. 3 is an elevation section view of an upper clutch part.
Figure 6:
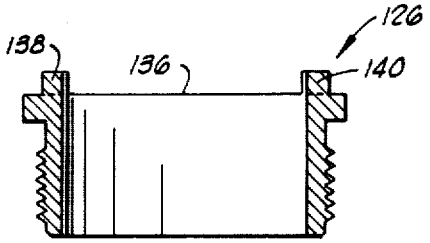
FIG. 6 is a sectioned elevation view of a lower clutch part.

A primary distinction between the pressure limiters 26A and 26 is shown in FIG. 2C where it can be seen that the lower end 158A of the coil compression spring 154A engages an upward facing shoulder 160A of clutch mandrel 70A while the upper end 156A of spring 154A engages a downward facing annular shoulder 200 of bearing housing 86A of lower housing part 32A.

The lower end 158A previously designated of spring 154A is actually a bottom surface of a spacer ring 202 which is placed between a lower coil 204 of spring 154A and the shoulder 160A of clutch mandrel 70 to vary the initial compression of coil spring 154A.

Thus, it is seen that the lower and upper ends 158A and 156A of the coil compression spring 154A engage the upper and lower housing parts 30A and 32A, respectively.

While this arrangement provides the same general manner of operation of the pressure limiter 26 of FIGS. 1A–1D, it is generally not as desirable because of the relative rotation between the surfaces, i.e. the shoulders 160A and 200, engaging the ends of the coil compression spring 154A. The embodiment of FIGS. 1A–1D eliminates this problem by having both ends of its coil compression spring 154 engaging a single one, i.e. the upper housing part 30, of the upper and lower housing parts 30 and 32 thereof.

The clutch mandrel 70A includes upper and lower outer cylindrical surfaces 206 and 170A, respectively, closely received within first and second inner cylindrical surfaces 208 and 172 of lower housing part 32A.

Seals 210 are provided between surfaces 206 and 208. Seals 174 are provided between surfaces 170A and 172. The annular differential surface of piston means 176A is therefore defined between an inner diameter defined by the diameter of upper outer cylindrical surface 206A of clutch mandrel 70A and an outer diameter defined by the diameter of lower outer cylindrical surface 170A of clutch mandrel 70A.

The general manner of operation of either of the pressure limiters 26 or 26A of the present invention, in combination with other components of the well testing assembly 10 as shown in FIG. 9, may therefore be generally described as follows.

The well testing assembly 10 is assembled in the manner shown and described with relation to FIG. 9, and is then lowered into place within the well hole 10 until the intake assembly 38 is located adjacent a subsurface formation 39, the production characteristics of which are to be tested.

The clutch assembly 122 is initially maintained in its engaged position as shown in FIG. 1D, due to the biasing from spring 154. This locks the lower pump portion 20 and all the components located therebelow relative to the well hole 12 so that upon rotation of the pipe string 10, the lower pump portion 20 is held in place and the upper pump portion 18 rotates relative thereto, thereby operating the pump 16 to produce pressurized fluid at the discharge thereof. This fluid is communicated through the inflation passage 106 to the inflatable packers 34 and 36 to inflate the same.

After the packers are inflated and the annulus 24 is sealed, the fluid pressure within the packers and within the inflation passage 106 communicating with the discharge of pump 16 rapidly increases with further operation of the pump 16. When this inflation pressure reaches the predetermined level, the upward force of this inflation pressure acting against the differential area piston means 176 moves the clutch mandrel 70 and the upper clutch part 124 upward relative to the lower clutch part 126 thereby disengaging the clutch means 122 so that the upper housing part 30 may rotate relative to the lower housing part 32. Since the lower pump part 20 and screen 22 are connected to the upper housing part 30 of pressure limiter 26, this also allows the lower pump part 20 to rotate with the upper pump part 18 as the pipe string 10 continues to be rotated. Since there is no further relative rotational movement between the upper and lower pump parts 18 and 20 the pump 16 ceases to operate and the discharge pressure within inflation passage 106 does not further increase.

Thus, it is seen that the downhole pump with pressure limiter of the present invention is readily adapted to achieve the ends and advantages mentioned as well as those inherent therein. While certain preferred embodiments of the invention have been illustrated for the purpose of this disclosure, numerous changes in the arrangement and construction of parts may be made by those skilled in the art which changes are included within the scope and spirit of this invention as defined by the appended claims.

What is claimed is:

1. A pressure limiter for a downhole pump, said pressure limiter comprising:

a housing having first and second housing parts, and having a fluid passage means disposed therein for communication with a discharge of said downhole pump;

clutch means connected to said first and second housing parts and movable between an engaged position for preventing relative rotational movement between said first and second housing parts and a disengaged position for allowing relative rotational movement between said first and second housing parts;

biasing means, operatively associated with said clutch means, for biasing said clutch means toward its engaged position; and piston means, operatively associated with said clutch means and communicated with said fluid passageway, for overcoming said biasing means and for moving said clutch means to its disengaged position at a predetermined fluid pressure level in said fluid passageway.

2. The pressure limiter of claim 1, wherein:

said biasing means includes a compression spring.

3. The pressure limiter of claim 2, wherein:

said compression spring includes first and second ends both of which engage a single one of said first and second housing parts.

4. The pressure limiter of claim 3, wherein:

said single one of said first and second housing parts is said first housing part;

said first housing part includes;

a clutch mandrel operatively associated with said clutch means and having a first annular radially extending shoulder;

an inner mandrel, received within said clutch mandrel and having a second annular radially extending shoulder facing said first shoulder; and interlocking means for preventing relative rotational movement between said clutch mandrel and inner mandrel while allowing relative longitudinal movement therebetween; and said compression spring is disposed between said first shoulder of said clutch mandrel and said second shoulder of said inner mandrel.

5. The pressure limiter of claim 4, wherein:

said compression spring is a coil spring concentrically disposed about said inner mandrel.

6. The pressure limiter of claim 4, wherein:

said interlocking means includes splines on said clutch mandrel and inner mandrel.

7. The pressure limiter of claim 4, wherein:

said piston means includes a differential area defined on said clutch mandrel and communicated with said fluid passageway.

8. The pressure limiter of claim 7, wherein:

said clutch mandrel includes an inner cylindrical surface within which is closely received an outer cylindrical surface of said inner mandrel;

said clutch mandrel further includes an outer cylindrical surface closely received within an inner cylindrical surface of said second housing part; and said differential area of said piston means is an annular area, having an inner diameter defined by said inner cylindrical surface of said clutch mandrel and an outer diameter defined by said outer cylindrical surface of said clutch mandrel.

9. The pressure limiter of claim 8, further comprising:

first annular sealing means disposed between said inner cylindrical surface of said clutch mandrel and said outer cylindrical surface of said inner mandrel; and second annular sealing means disposed between said outer cylindrical surface of said clutch mandrel and said inner cylindrical surface of said second housing part.

10. The pressure limiter of claim 4, wherein said clutch means comprises:

a first clutch part attached to said clutch mandrel of said first housing part and having a first annular surface with a first pair of longitudinally extending lugs disposed thereon; and a second clutch part attached to said second housing part and having a second annular surface facing said first annular surface with a second pair of longitudinal extending lugs disposed thereon, said pressure limiter being so arranged and constructed that when a fluid pressure within said fluid passageway is below said predetermined level said biasing means urges said first pair of lugs into engagement with said second pair of lugs to prevent relative rotational movement between said first and second housing parts, and when said fluid pressure is above said predetermined level said piston means moves said first pair of lugs out of engagement with said second pair of lugs to allow relative rotational movement between said first and second housing parts.

11. The pressure limiter of claim 10, wherein:

said first and second pairs of lugs include sloped engaging surfaces arranged so that torque transmitted thereacross creates a longitudinal force component therebetween urging said first and second pairs of lugs toward a disengaged position.

12. The pressure limiter of claim 2, wherein:

said compression spring includes first and second ends engaging said first and second housing parts, respectively.

13. The pressure limiter of claim 12, wherein:

said first housing part includes a clutch mandrel, operatively associated with said clutch means and having a first annular radially extending shoulder;

said second housing part includes a second annular radially extending shoulder facing said first shoulder; and said compression spring is disposed between said first shoulder of said clutch mandrel and said second shoulder of said second housing part.

14. The pressure limiter of claim 13, wherein:

said first housing part further includes an inner mandrel, received within said clutch mandrel, and interlocking means for preventing relative rotational movement between said clutch mandrel and inner mandrel while allowing relative longitudinal movement therebetween.

15. The pressure limiter of claim 14, wherein:

said interlocking means includes splines on said clutch mandrel and inner mandrel.

16. The pressure limiter of claim 13, wherein:

said compression spring is a coil spring concentrically disposed about said clutch mandrel.

17. The pressure limiter of claim 13, wherein:

said piston means includes a differential area defined on said clutch mandrel and communicated with said fluid passageway.

18. The pressure limiter of claim 17, wherein:

said clutch mandrel includes first and second outer cylindrical surfaces closely received within first and second inner cylindrical surfaces, respectively, of said second housing part; and said differential area of said piston means is an annular area having an inner diameter and an outer diameter defined by said first and second outer cylindrical surfaces, respectively, of said clutch mandrel.

19. The pressure limiter of claim 18, further comprising:

first annular sealing means disposed between said first outer cylindrical surface of said clutch mandrel and said first inner cylindrical surface of said second housing part; and second annular sealing means disposed between said second outer cylindrical surface of said clutch mandrel and said second inner cylindrical surface of said second housing part.

20. The pressure limiter of claim 19, wherein:

said compression spring is longitudinally located between said first and second annular sealing means.

21. The pressure limiter of claim 13, wherein said clutch means comprises:

a first clutch part attached to said clutch mandrel of said first housing part and having a first annular surface with a first pair of longitudinally extending lugs disposed thereon; and a second clutch part attached to said second housing part and having a second annular surface facing said first annular surface with a second pair of longitudinal extending lugs disposed thereon, said pressure limiter being so arranged and constructed that when a fluid pressure within said fluid passageway is below said predetermined level said biasing means urges said first pair of lugs into engagement with said second pair of lugs to prevent relative rotational movement between said first and second housing parts, and when said fluid pressure is above said predetermined level said piston means moves said first pair of lugs out of engagement with said second pair of lugs to allow relative rotational movement between said first and second housing parts.

22. The pressure limiter of claim 21, wherein:

said first and second pairs of lugs include sloped engaging surfaces arranged so that torque transmitted thereacross creates a longitudinal force component therebetween urging said first and second pairs of lugs toward a disengaged position.

23. A well testing assembly, comprising:

a pipe string;

a downhole pump having an upper pump portion connected to a lower end of said pipe string, and having a lower pump portion operably associated with said upper pump portion so that said pump is operated upon relative rotational motion between said upper and lower pump portions;

an inflatable packer means, located below said downhole pump, for sealing an annulus between said pipe string and a well hole when inflated with pressurized fluid from a discharge of said downhole pump;

drag means for preventing rotational motion of said inflatable packer means within said well hole; and a pressure limiter means for limiting a fluid pressure communicated from said discharge of said donwhole pump to said inflatable packer means, said pressure limiter means including:

a housing having an upper housing part connected to said lower pump portion and a lower housing part connected to said inflatable packer means, and having an inflation passage disposed therethrough communicating said discharge of said downhole pump with said inflatable packer means;

clutch means connected to said upper and lower housing parts, and movable between an engaged position for preventing relative rotational movement between said upper and lower housing parts and for holding said lower pump portion fixed relative to said well hole so that said downhole pump is operated upon rotation of said pipe string, and a disengaged position for allowing relative rotational movement between said upper and lower housing parts and for allowing said lower pump portion to rotate with said upper pump portion upon rotation of said pipe string to prevent operation of said pump;

biasing means, operatively associated with said clutch means, for biasing said clutch means toward its engaged position; and piston means, operatively associated with said clutch means and communicated with said inflation passage, for overcoming said biasing means and for moving said clutch means to its disengaged position at a predetermined fluid pressure level in said inflation passage.

24. The well testing assembly of claim 23, wherein:

said biasing means includes a compression spring.

25. The well testing assembly of claim 24, wherein:

said compression spring includes first and second ends both of which engage a single one of said upper and lower housing parts.

26. The well testing assembly of claim 25, wherein:

said single one of said upper and lower housing parts is said upper housing part;

said upper housing part includes:

a clutch mandrel, operatively associated with said clutch means and having a first annular radially extending shoulder;

an inner mandrel, received within said clutch mandrel and having a second annular radially extending shoulder facing said first shoulder; and interlocking means for preventing relative rotational movement between said clutch mandrel and inner mandrel while allowing relative longitudinal movement therebetween; and said compression spring is disposed between said first shoulder of said clutch mandrel and said second shoulder of said inner mandrel.

27. The well testing assembly of claim 26, wherein:

said compression spring is a coil spring concentrically disposed about said inner mandrel.

28. The well testing assembly of claim 26, wherein:

said interlocking means includes splines on said clutch mandrel and inner mandrel.

29. The well testing assembly of claim 26, wherein:

said piston means includes a differential area defined on said clutch mandrel and communicated with said inflation passage.

30. The well testing assembly of claim 29, wherein:

said clutch mandrel includes an inner cylindrical surface within which is closely received an outer cylindrical surface of said inner mandrel;

said clutch mandrel further includes an outer cylindrical surface closely received within an inner cylindrical surface of said lower housing part; and said differential area of said piston means is an annular area having an inner diameter defined by said inner cylindrical surface of said clutch mandrel and an outer diameter defined by said outer cylindrical surface of said clutch mandrel.

31. The well testing assembly of claim 30, further comprising:

first annular sealing means disposed between said inner cylindrical surface of said clutch mandrel and said outer cylindrical surface of said inner mandrel; and second annular sealing means disposed between said outer cylindrical surface of said clutch mandrel and said inner cylindrical surface of said lower housing part.

32. The well testing assembly of claim 26, wherein said clutch means comprises:

a first clutch part attached to said clutch mandrel of said upper housing part and having a first annular surface with a first pair of longitudinally extending lugs disposed thereon; and a second clutch part attached to said lower housing part and having a second annular surface facing said first annular surface with a second pair of longitudinally extending lugs disposed thereon, said pressure limiter means being so arranged and constructed that when a fluid pressure within said inflation passage is below said predetermined level said biasing means urges said first pair of lugs into engagement with said second pair of lugs to prevent relative rotational movement between said upper and lower housing parts, and when said fluid pressure is above said predetermined level said piston means moves said first pair of lugs out of engagement with said second pair of lugs to allow relative rotational movement between said upper and lower housing parts.

33. The well testing assembly of claim 32, wherein:

said first and second pairs of lugs include sloped engaging surfaces arranged so that torque transmitted thereacross creates a longitudinal force component therebetween urging said first and second pairs of lugs toward a disengaged position.

34. The well testing assembly of claim 24, wherein:

said compression spring includes first and second ends engaging said upper and lower housing parts, respectively.

35. The well testing assembly of claim 34, wherein:

said upper housing part includes a clutch mandrel, operatively associated with said clutch means and having a first annular radially extending shoulder;

said lower housing part includes a second annular radially extending shoulder facing said first shoulder; and said compression spring is disposed between said first shoulder of said clutch mandrel and said second shoulder of said lower housing part.

36. The well testing assembly of claim 35, wherein:

said upper housing part further includes an inner mandrel, received within said clutch mandrel, and interlocking means for preventing relative rotational movement between said clutch mandrel and inner mandrel while allowing relative longitudinal movement therebetween.

37. The well testing assembly of claim 36, wherein:

said interlocking means includes splines on said clutch mandrel and inner mandrel.

38. The well testing assembly of claim 35, wherein:

said compression spring is a coil spring concentrically disposed about said clutch mandrel.

39. The well testing assembly of claim 35, wherein:

said piston means includes a differential area defined on said clutch mandrel and communicated with said inflation passage.

40. The well testing assembly of claim 39, wherein:

said clutch mandrel includes first and second outer cylindrical surfaces closely received within first and second inner cylindrical surfaces, respectively, of said lower housing part; and said differential area of said piston means is an annular area having an inner diameter and an outer diameter defined by said first and second outer cylindrical surfaces, respectively, of said clutch mandrel.

41. The well testing assembly of claim 40, further comprising:

first annular sealing means disposed between said first outer cylindrical surface of said clutch mandrel and said first inner clyindrical surface of said lower housing part; and second annular sealing means disposed between said second outer cylindrical surface of said clutch mandrel and said second inner cylindrical surface of said lower housing part.

42. The well testing assembly of claim 41, wherein:

said compression spring is longitudinally located between said first and second annular sealing means.

43. The well testing assembly of claim 35, wherein said clutch means comprises:

a first clutch part attached to said clutch mandrel of said upper housing part and having a first annular surface with a first pair of longitudinally extending lugs disposed thereon; and a second clutch part attached to said lower housing part and having a second annular surface facing said first annular surface with a second pair of longitudinal extending lugs disposed thereon, said pressure limiter means being so arranged and constructed that when a fluid pressure within said inflation passage is below said predetermined level said biasing means urges said first pair of lugs into engagement with said second pair of lugs to prevent relative rotational movement between said upper and lower housing parts, and when said fluid pressure is above said predetermined level said piston means moves said first pair of lugs out of engagement with said second pair of lugs to allow relative rotational movement between said upper and lower housing ports.

44. The well testing assembly of claims 43, wherein:

said first and second pairs of lugs include sloped engaging surfaces arranged so that torque transmitted thereacross creates a longitudinal force component therebetween urging said first and second pairs of lugs toward a disengaged position.

45. A well testing assembly, comprising:

a pipe string;

a downhole pump connected to said pipe string; and a pressure limiter means, operably associated with said downhole pump, for limiting a fluid pressure communicated from a discharge of said downhole pump to another apparatus connected to said pipe string, said pressure limiter means including:

a housing having first and second housing parts, and having a fluid passage means disposed therein for communication with said discharge of said downhole pump;

clutch means connected to said first and second housing parts and movable between an engaged position for preventing relative rotational movement between said first and second housing parts and a disengaged position for allowing relative rotational movement between said first and second housing parts;

biasing means, operatively associated with said clutch means, for biasing said clutch means toward its engaged position; and piston means, operatively associated with said clutch means and communicated with said fluid passageway, for overcoming said biasing means and for moving said clutch means to its disengaged position at a predetermined fluid pressure level in said fluid passageway.

46. A downhole tool, comprising:

a downhole pump having an upper pump portion adapted to be connected to a lower end of a pipe string, and having a lower pump portion operably associated with said upper pump portion so that said pump is operated upon relative rotational motion between said upper and lower pump portions; and a pressure limiter means, located below and operatively associated with said downhole pump, for holding said lower pump portion fixed relative to a bore of a well until a discharge pressure of said downhole pump reaches a predetermined level, and for allowing said lower pump portion to rotate with said upper pump portion thus preventing any increase in said discharge pressure after said discharge pressure reaches said predetermined level.

47. A method of operating a downhole pump, comprising:

placing said downhole pump in a well bore, said downhole pump having an upper pump portion connected to a lower end of a pipe string, and having a lower pump portion operably associated with said upper pump portion so that said pump is operated upon relative rotational motion between said upper and lower pump portions;

rotating said drill string to rotate said upper pump portion to operate said downhole pump;

holding said lower pump portion rotationally fixed relative to said well bore until a discharge pressure of said downhole pump reaches a predetermined level; and releasing said lower pump portion relative to said well bore and allowing said lower pump portion to rotate with said upper pump portion thus preventing any increase in said discharge pressure after said discharge pressure reaches said predetermined level.

48. The method of claim 47, wherein:

said releasing step includes a step of moving a clutch, connected between said lower pump portion and another structure rotationally fixed relative to said well bore, to a disengaged position.

49. The method of claim 48, further comprising:

biasing said clutch toward an engaged position wherein said lower pump portion is held rotationally fixed relative to said well bore.

50. The method of claim 49, wherein:

said step of moving said clutch to its said disengaged position includes a step of applying said discharge pressure of said downhole pump to a piston connected to said clutch, and thereby moving said piston to overcome said biasing of said clutch and to move said clutch to its said disengaged position.

* * * * *